United States Patent [19]

Zurawin et al.

[11] 4,219,899

[45] Sep. 2, 1980

[54] PAINT PAD ASSEMBLY

[76] Inventors: Adam Zurawin, 303 E. 57th St., New York, N.Y. 10022; Gaetano Ricciuti, 3003 Wallace Ave., Bronx, N.Y. 10467

[21] Appl. No.: 6,236

[22] Filed: Jan. 24, 1979

Related U.S. Application Data

[62] Division of Ser. No. 843,212, Oct. 18, 1977, Pat. No. 4,164,803.

[51] Int. Cl.[2] ..... B25G 3/38; B44D 3/00

[52] U.S. Cl. ..... 15/144 A; 15/210 R; 403/57

[58] Field of Search ..... 15/144 A, 144 R, 145, 15/172, 210 R, 244 A; 403/57

[56] References Cited

U.S. PATENT DOCUMENTS

| | | | |
|---|---|---|---|
| 3,029,454 | 4/1962 | Short et al. | 15/144 A X |
| 3,473,183 | 10/1969 | Burns et al. | 15/144 R |
| 3,717,896 | 2/1973 | Chase et al. | 15/144 A X |

*Primary Examiner*—Philip R. Coe

*Attorney, Agent, or Firm*—Hubbell, Cohen, Stiefel & Gross

[57] ABSTRACT

A paint pad support and handle assembly includes a paint pad support body and a handle which is mounted to the support for swinging movement of about 90° extent about an axis parallel to the plane of the support body and for pivotal movement about an axis perpendicular to the plane of the support body. A spring clip is used for biasing the handle without interfering with its free swing.

1 Claim, 8 Drawing Figures

PAINT PAD ASSEMBLY

This is a division of application Ser. No. 843,212, filed 10/18/77, and now U.S. Pat. No. 4,164,803.

BACKGROUND OF THE INVENTION

1. Field of the Invention

This invention relates generally to paint pad support and handle assemblies and more particularly to handles which are swingingly mounted to the paint pad supports.

2. The Prior Art

A conventional paint pad handle is shown, for example, in U.S. Pat. No. 3,629,894. According to that patent, the upper paint pad plate may be slid into a particular position lengthwise of the handle. Once the pad is affixed to the handle, the handle may not be pivotally moved in any direction with respect to the pad, thus making it difficult to apply paint evenly on a wall or ceiling when a painter is using a long extension stick extending out from within the handle. Pivoted handles for sponge mops and other implements are, of course, well known.

SUMMARY OF THE INVENTION

The present invention provides a paint pad support and handle assembly suitable for use with the paint pan and transfer roller assembly described in U.S. Pat. No. 4,164,803, which includes a handle mounting that is connected to the pad support for pivotal movement about an axis perpendicular to the plane of the support, and for a swinging movement about an axis parallel to the plane of the support. Means are included for releasably holding the pad relative to the handle about the perpendicular axis, and means are further included for biasing said pad support in a given direction about said parallel axis.

DETAILED DESCRIPTION OF THE INVENTION

Several problems have been encountered heretofore in the use of paint pads which the present invention solves. Thus, for example, when a user is painting a ceiling with a paint pad having a fixed handle to which an extension stick is connected, in order to maintain the pad in surface-to-surface relation with the ceiling being painted, the user must walk with the paint pad against the ceiling since any pivoting or swinging movement of the pad past the user will move the surface of the pad at least in part out of contact with the ceiling, thereby defeating one of the advantages of such pads. Similarly, when a user is painting a wall surface immediately adjacent the ceiling, it has been difficult to bring the entire length of the pad into painting relation with the area being painted due to the fixed position of the handle relative to the painting pad. These two previously encountered problems are solved in the present invention.

Thus, for example, in accordance with the present invention, a handle connectable to an extension stick or rod may be pivotally connected to the painting pad support. The pivot axis is disposed in a plane parallel to the plane of the pad. Thus, if the handle is oriented so that the axis of said pivot is also parallel to the longitudinal axis of the pad, a user may stand stationary, press the pad against the ceiling surface and swing the pad past him while maintaining the entire pad in surface-to-surface relation with the ceiling, causing the pad to pivotally rotate about said axis. As will be seen hereinafter, this desirable effect may be enhanced by biasing the pad in a given direction relative to the handle. Such bias tends to exert a contact pressure between the pad and the ceiling surface to enhance the painting effect.

Similarly, means may be provided to adjust the position of the painting pad relative to the axis of the handle in order to accommodate painting along regions of a wall immediately adjacent the ceiling or another wall. Such means may take many forms and the presently preferred form will be described hereinafter.

FIGS. 1 through 8 illustrate a paint pad support and handle assembly including, for illustrative purposes, the presently preferred means for swingingly connecting a paint pad support to a handle for movement about an axis parallel to the longitudinal axis of the pad support and, further, for movement about a second axis perpendicular to the plane of the pad support. Of course, other means for performing these functions are readily within the contemplation of the skilled art worker and are intended to be included in the scope of this invention. The illustrated and hereinafter described paint pad assembly is especially suited for use with the convertible paint pad/paint roller pan described in U.S. Pat. No. 4,164,803.

Figures 1, 2:
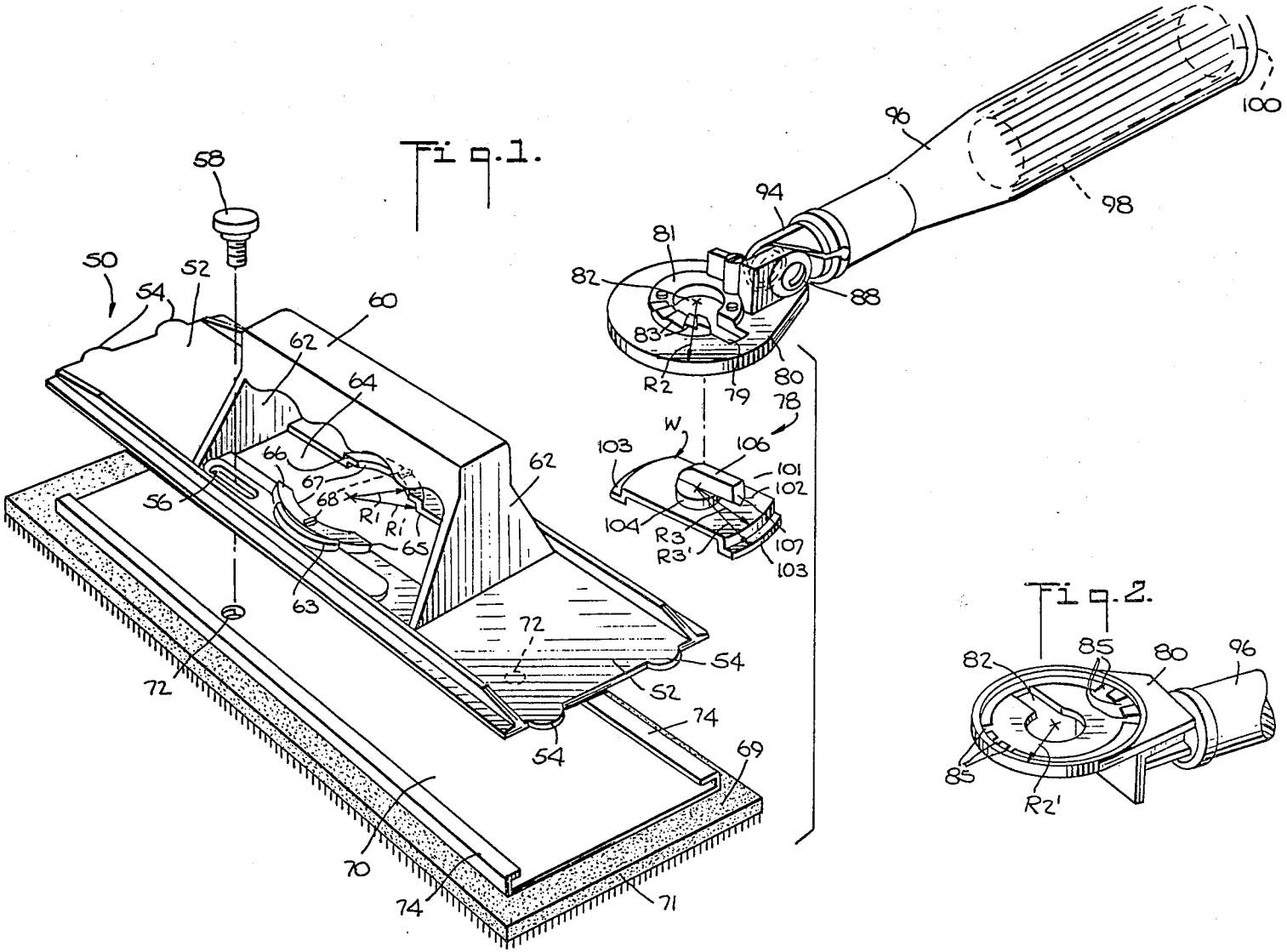
FIG. 1 is an exploded perspective view of a paint pad and paint pad support, and a support handle embodying other features of this invention.
FIG. 2 is a perspective view of the underside of one of the handle connecting means shown in FIG. 1.

In FIG. 1, and designated generally by numeral 50, is a paint pad support member having a generally rectangularly shaped substantially planar body 52. An opening 64 is provided through the center portion of the body 52. Opening 64 is generally rectangular but is provided with centrally located concentric arcuate portions 65 in the opposed longitudinally extending sides thereof. Two upwardly extending flanges 66 are formed about opposed arcuate portions 65 and are provided with inwardly directed lips 67 to define oppositely facing arcs of a circle having a radius R1. Disposed midway and extending up from the lip 67 of each of the flanges 66 is a locating tab 68. The upstanding flange walls define oppositely facing arcs of a circle of radius R1'. An arcuate guide wall 63 is formed on the support body 52 adjacent one of the flanges 66 to define a guide channel therebetween.

Figure 3:
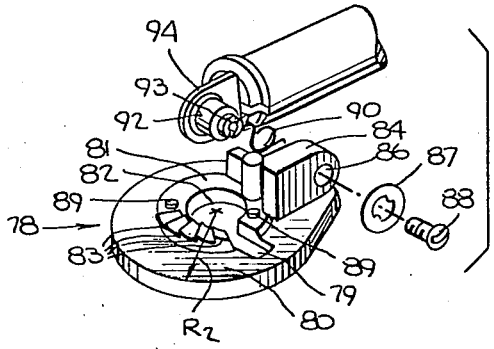
FIG. 3 is an exploded perspective view of one end of the handle and one of the connecting means to be connected thereat.

Referring also to FIGS. 2 and 3, a handle assembly suitable for connecting to the paint pad support 52 at the opening 64 is shown in detail. The assembly includes a handle 96 having connecting means 78 one of which is pivotally connected to one end of the handle 96. The handle 96 includes a grip portion 98 extending to the other end thereof and has a bore 100 extending axially therethrough from the other end towards said one end. The bore 100 is interiorally formed to securely engage conventional wood or aluminum extension sticks. Any conventional interior formation such as a thread may be used and is therefore not shown in detail in FIG. 1. An ear portion 94 extends out from the one end of the handle 96, and has a bushing 92 provided thereon with a threaded hole 93 extending through the bushing 92.

The connecting means 78 includes a cap 80 having a keyhole shaped opening 82 through its body. The opening 82 includes a rectangular slot 79. The cap 80 is circularly shaped and has an outer radius R2 which is greater than the radius R1 defining the circular center portion of the opening 64 through the paint pad support body 52. Further, the circular wall of the cap has an inside radius R2′ slightly greater than the sum of the radius R1 of the opening 64 and the width of the upper lips 67 of the flanges 66. It will be understood that if the outer and inner radii R2, R2′, respectively, of the cap 80 are chosen as described, the cap will seat about the flanges 66 when placed thereover, and may be brought to operatively bear against the surface of the support body 52.

Extending upwardly at the center of the top of the cap 80 is a hub 81 which surrounds the circular portion of the keyhole opening 82. Further, extending along the top surface of the hub 81 from the rectangular slot 79 are a series of saw-toothed steps 83. Also extending upward from the hub 81 are two diametrically opposed crank stop members 89, one of which is disposed immediately after the last one of the steps 83 which extend along the hub 81 from the rectangular slot 79.

On the underside of the cap 80 and immediately adjacent the circular wall of the cap are a plurality of circumferentially distributed radially extending indentations 85, each one being located to receive one of the locating tabs 68 extending up from the flanges 66 on the paint pad support body 52 when the cap 80 is seated about the flange 66.

As more clearly seen in FIG. 3, an upstanding ear portion 84 on the top of the cap 80 has an opening 86 provided therethrough to accommodate for smooth rotation of the bushing 92 which extends from the handle ear portion 94. A screw 88 extends through a bushing lock washer 87 and the opening 86 to engage the threaded hole 93. A circular spring clip 90 surrounds the bushing 92 and has its ends anchored in ear portions 84, 94, respectively.

Referring again to FIG. 1, the connecting means 78 also includes an elonagated flat jam 101 having a flat bar element 102 with arcuate ends defined by a radius R3 drawn from the center of the bar element 102. The width W of the bar 102 is such as to allow the jam 101 to freely pass through the opening 64 in the paint pad support body 52 when the bar 102 is oriented lengthwise of the opening 64. Extending downwardly and outwardly at each of the ends of the bar 102 are steps 103 having outer edges defined by a radius R3′ drawn from the center axis of the jam 101. The radius R3′ thus defines the outer radius of the jam 101, and is such as to provide a tight fit for the jam 101 against the inside walls of the flanges 66 on the support body 52. Thus, the radius R3′ is substantially equal to the radius R1′ of the upstanding walls of the flanges 66.

The jam 101 also includes a hub portion 104 disposed centrally on and extending upwardly therefrom, and a crank handle 106 joined to the hub portion 104. The hub portion 104 and handle 106 are dimensioned to allow their passage up through the keyhole opening 82 in the cap 80. The bottom portion 107 of the crank handle 106 has a triangular cross section formed to operatively engage a desired one of the saw toothed steps 83 formed on the top surface of the cap hub 81. It will be apparent that the crank handle 106 prevents the jam 101 from being separated from the cap when the crank handle 106 is passed through the keyhole 82 and rotated across the steps 83.

Figure 4:
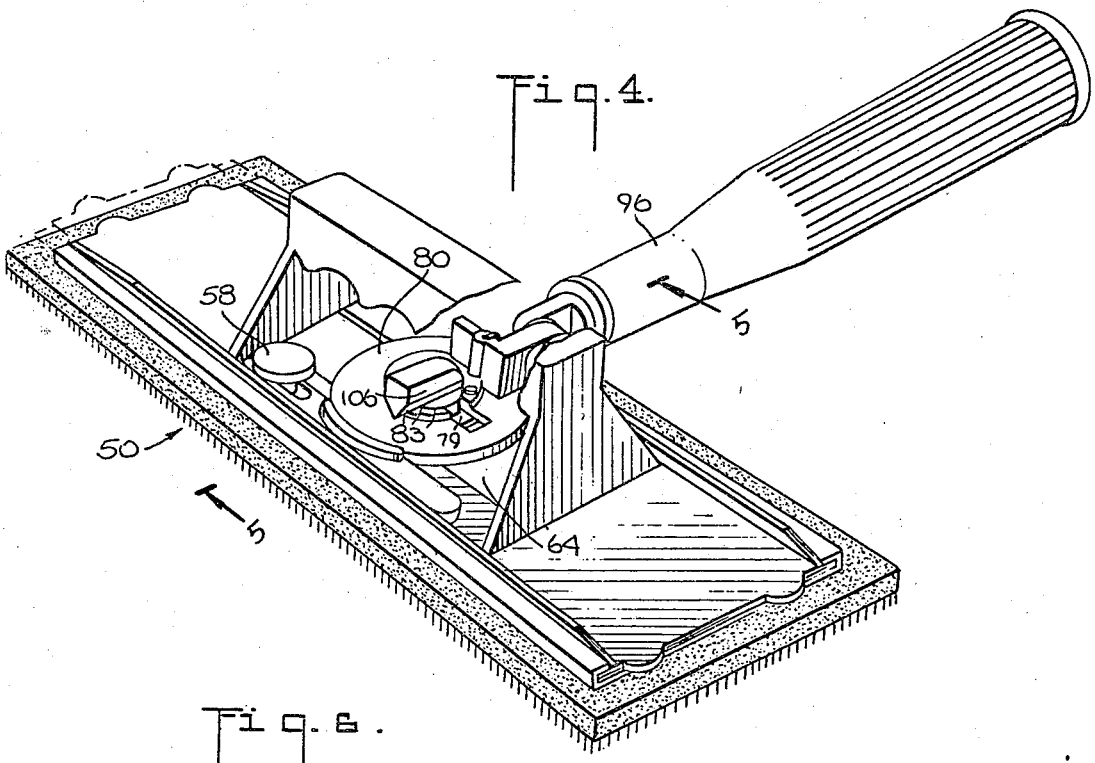
FIG. 4 is a perspective view of a paint pad support and handle assembly embodying the present invention operatively joined to one another.
Figure 6:
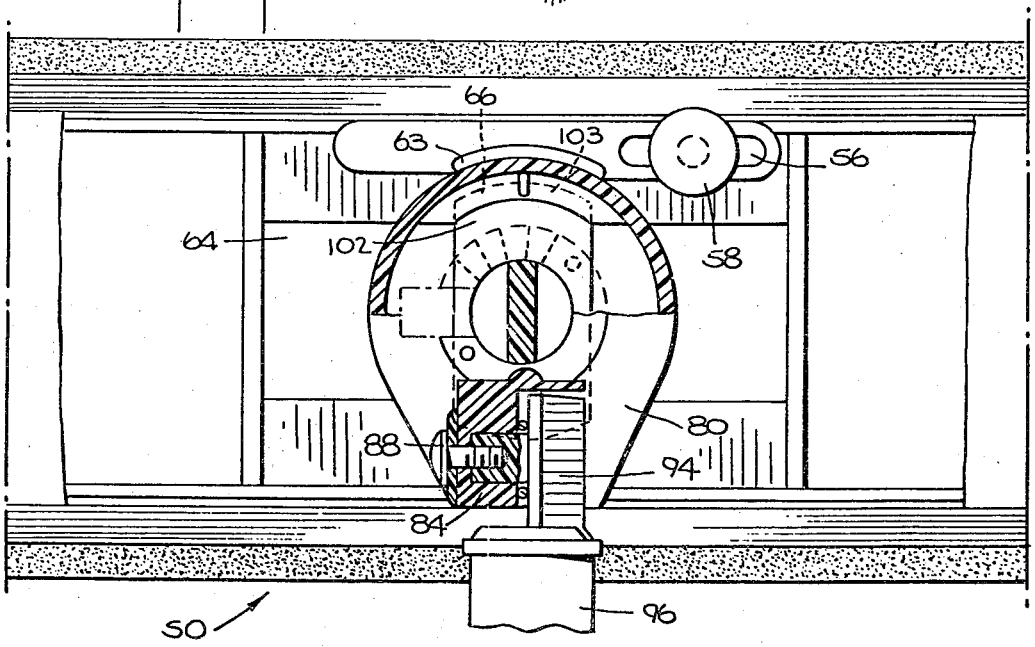
FIG. 6 is a top view, partly in section and partly in plan, of the handle connecting means operatively joined to the paint pad support member.
Figure 5:
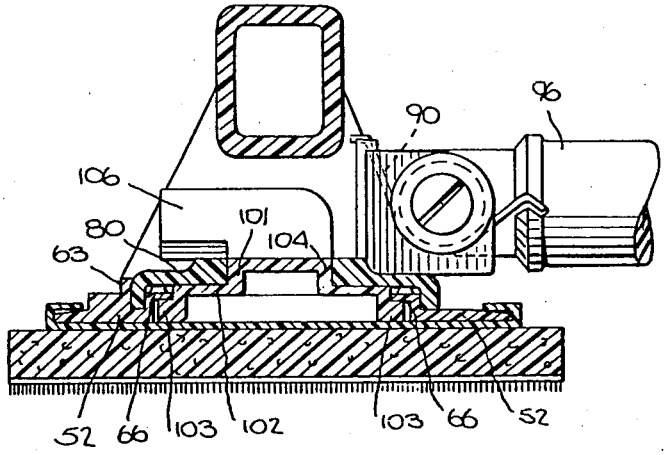
FIG. 5 is a sectional view taken along the line 5—5 of FIG. 4.

The joinder of the handle assembly in FIGS. 1, 2 and 3 to the paint pad support 50 in FIG. 1 is illustrated in FIGS. 4, 5 and 6. The jam 101 is rotatably mounted within the cap 80 by passing the crank handle 106 and hub portion 104 on the jam 101 through the keyhole 82 in the cap 80. Before turning the crank handle 106, the cap 80 is seated over the flanges 66 on the paint pad support body 52 so that the jam bar element 102 and its outward steps 103 are disposed lengthwise within the opening 64 in the support body 52. The jam 101 is held in this position by way of the crank 106 while the handle 96 is brought to a desired azimuthal position with respect to the support body 52. It will be understood that such movement of the handle 96 will cause the cap 80, which is pivotally connected thereto, to rotate over the flanges 66. During the aforesaid rotation of the cap 80, different pairs of indentations 85 provided on the bottom surface thereof will engage respective ones of the locating tabs 68 standing upwardly from each of the two flanges 66.

Figure 7:
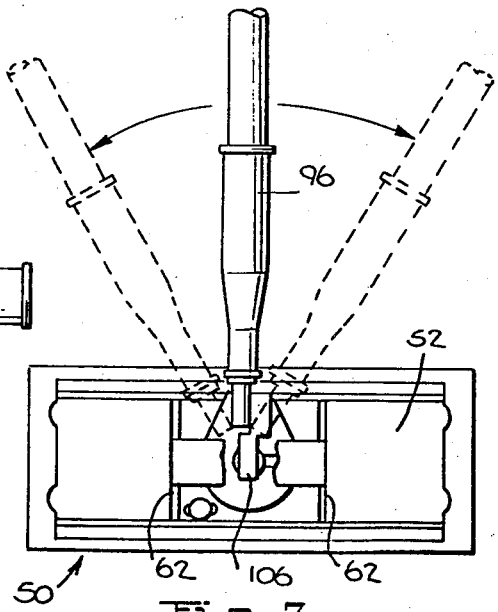
FIG. 7 is a top plan view of the paint pad support and handle assembly illustrating several operative positions of said handle relative to the pad support.

When a desired position for the handle is attained at which a particular pair of indentations 85 engage the locating tabs 68, the crank handle 106 on the jam 101 is turned to thereby forcibly position the jam bar 102 symmetrically between the opposing walls and lips 67 of the flanges 66. The crank handle 106 will then be transverse to the support body 52 and the lower portion 107 of the crank handle will forcibly operatively bear against one of the saw-toothed steps 83 on the hub 81 of the cap 80. It will be appreciated that after the handle assembly is so joined to the paint pad support body 52, the handle 96 will be locked in the desired azimuthal position with respect to the paint pad support 50, partly because of the engagement of the locating tabs 68 with a pair of the indentations 85. FIG. 7 shows the handle 96 in one of three possible operative positions, for example.

Although the underside of the cap member 80, as shown in FIG. 2, appears as having a series of three pairs of diametrically opposed indentations 85 thereon, it will be understood that if additional indentations 85 are provided thereat, and a corresponding number of additional locating tabs 68 are provided on the flanges 66 of the paint pad support body 52, it will then be possible to more securely connect the handle 96 to the support body 52 at a desired azimuthal position whereat all of the locating tabs 68 are seated within corresponding pairs of the indentations 85. It has been found, for example, that two additional locating tabs 68 can be provided on each of the flanges 66, symmetrically disposed about each of the locating tabs 68 shown in FIG. 1. These additional locating tabs may then selectively engage four more pairs of indentations provided on the underside of the cap 80, when the additional indentations are disposed further about the indentations 85 shown in FIG. 2. The handle 96 can then be secured at each of the above mentioned three azimuthal positions with even greater rigidity than if only one pair of locating tabs 68 engage a single pair of indentations 85 at each selected operating position for the handle 96.

Figure 8:
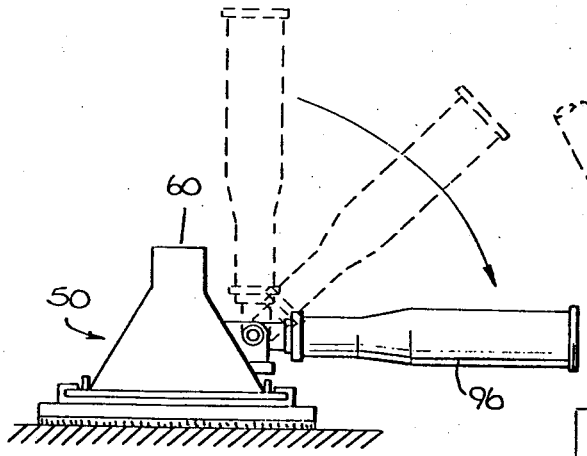
FIG. 8 is a side elevation view of the paint pad support and handle assembly illustrating several other operative positions of said handle relative to the pad support.

A further feature of the present invention is the provision of a spring bias force to urge the handle 96 in a given angular direction with respect to the support body 52, here shown to be parallel thereto in FIG. 8, although a perpendicular direction will work as well. As explained above in regard to FIG. 3, the handle 96 is joined to the cap 80 by means of a pivot screw 88 and bushing 92 on which a circular spring clip 90 is disposed. Because the ends of the spring clip 90 are anchored to portions of the bodies of the cap 80 and handle 96, respectively, when the handle assembly is connected by way of the cap 80 to the paint pad support body 52, the latter will be biased to a first elevational position with respect to the handle 96 due to the action of the spring clip 90. Thus, any rotational movement of the paint pad support body 52 away from this first position will be counteracted by a torque developed by the spring clip 90 in response to such movement.

The above-described spring bias feature of the present invention is further illustrated in FIG. 8. There, it is seen that the handle 96, having been connected to the paint pad guide member 50 by way of the connecting means 78, may be swingingly rotated with respect to the connecting means 78 and paint pad support 50 from a lowermost position in line with the surface of the pad, to which it is urged by the action of the spring clip 90, to an uppermost position beyond which further rotation is prevented by a bar handle 60. It will also be appreciated that it is necessary to prevent further rotation of the handle 96 in the upper direction so that the spring clip 90 will not be damaged thereby.

Still other features of the present invention are now described in regard to the paint pad support in FIG. 1. A paint pad 69, suitable for use with the pad support 50 of the present invention, includes an absorbent paint pad material 71 having a rectangular shape and being dimensioned slightly greater than the overall rectangular dimensions of the support body 52. The paint pad 69 also includes a channel member 70 of rectangular shape which is joined symmetrically to the top of the paint pad material 71. Two threaded holes 72 extend through the channel member 70. The channel member 70 has flanges 74 formed along its longer sides, respectively, the flanges 74 being shaped and spaced apart from one another so that the channel member 70 will engage and slide firmly along the longer edges of the support body 52 which edges are tapered as shown. Further, a slot 56 is provided through the support body 52. The locations of the threaded holes 72 through the channel member 70 are such that when the paint pad 69 engages the support body 52 and is moved lengthwise with respect thereto, one of the holes 72 will be aligned under the slot 56 so that the channel member 70 may be fixedly secured to the body 52 by means of a fastener 58 insertable through the slot 56 for engaging the interior of hole 72. The slot 56 allows the paint pad to assume varied positions relative to the support body 52, before being tightly secured thereto, in order to permit edge painting to be carried out with the aid of arcuate spacing ears 54. The spacing ears 54 extend outwardly a uniform distance from each of the shorter sides of the support body 52. The paint pad support 50 also includes the bar handle 60 which extends lengthwise of the support body 52 above its opening 64 and is supported on both sides of the opening 64 by way of a pair of walls 62 extending up from the support body 52. The bar handle 60 allows for painting without the handle assembly described herein for close-up painting by a user.

Having thus fully described the present invention, what is claimed as new and desired to be secured by Letters Patent is:

1. In a paint pad support and handle assembly of the type used to support a removable paint pad and to guide said pad across a surface to be painted, the improvement comprising:

a substantially planar paint pad support body;

a handle;

means for mounting said handle on said support body for swinging movement of about 90° about a first axis substantially parallel to the plane of said support body at a turning point located above and to one side of the main axis of said paint pad support body for maintaining said pad in surface-to-surface relation with the surface being painted independent of the position of the user relative to said paint pad and for pivotal movement about a second axis substantially perpendicular to the plane of said support body; and a circular spring clip located substantially at and around said turning point for biasing said handle in a given direction of swinging movement therearound.

* * * * *